United States Patent [19]

Kling

[11] 4,191,161

[45] Mar. 4, 1980

[54] FIREPLACE HEATER

[76] Inventor: William E. Kling, 6647 Tanglewood Dr., SE., Grand Rapids, Mich. 49506

[21] Appl. No.: 853,267

[22] Filed: Nov. 21, 1977

[51] Int. Cl.[2] ..... F24B 7/00

[52] U.S. Cl. ..... 126/121; 126/134; 126/131

[58] Field of Search ..... 126/121, 134, 131, 132, 126/113

[56] References Cited

U.S. PATENT DOCUMENTS

| | | | |
|---|---|---|---|
| 438,319 | 10/1890 | Libbey | 126/121 |
| 668,850 | 2/1901 | Connell | 126/134 |
| 1,629,384 | 5/1927 | Holland | 126/134 |
| 1,747,259 | 2/1930 | Pierce | 126/121 |
| 1,959,558 | 5/1934 | Van Daam | 126/86 |
| 2,052,643 | 9/1936 | Modine | 126/121 |
| 3,001,521 | 9/1961 | Reilly | 126/165 |
| 3,866,595 | 2/1975 | Jones | 126/121 |
| 4,008,707 | 2/1977 | Bartlett | 126/131 |
| 4,010,729 | 3/1977 | Egli | 126/121 |
| 4,068,650 | 1/1978 | Nelson | 126/121 |

*Primary Examiner*—Carroll B. Dority, Jr.
*Assistant Examiner*—Lee E. Barrett
*Attorney, Agent, or Firm*—John E. McGarry

[57] ABSTRACT

A fireplace heater having a central grate and a U-shaped container with two side sections and a rear section substantially surrounding the central grate. An air inlet is at the upper portion of a front end of one side section. A fan is mounted adjacent the intake for circulating air into and through the container. At the front portion of the second side section is an outlet for the passage of heated, circulating air. The bottom portion of the U-shaped container holds water which is heated by a fire on the grate. The water evaporates and humidifies the circulating air before passing into the room through the outlet.

5 Claims, 4 Drawing Figures

FIREPLACE HEATER

BACKGROUND OF THE INVENTION

1. Field of the Invention

This invention relates generally to an open fireplace grate, and more particularly to fireplace grates in which air can be heated, moistened and discharged back into a heated room.

2. Description of the Prior Art

Fireplace heaters have long been used to improve the efficiency of a fireplace in heating a room. One such fireplace heater is disclosed in U.S. Pat. No. 1,747,259 issued to J. F. Pierce on Feb. 18, 1930. Pierce discloses a plurality of tubular conduits having a bottom portion which forms a grate, a rear portion, and top portion which passes over the fire and out to the front of the fireplace. The tubular shape causes a convection current at the inlet at the bottom grate conduit to pass through the tubes up to the top outlet whereby the fire heats the air within the conduits. A water trough is positioned below the outlets to contain water which vaporizes and is dissipated by the convection currents.

A portable fireplace heater is disclosed in U.S. Pat. No. 2,052,643 issued to Modine on Sept. 1, 1936. The Modine heater has two side chambers spaced apart with flues extending between the two chambers and a grate positioned between the chambers. A fan is positioned adjacent an inlet in one chamber and an outlet with directional flaps is positioned in the other chamber. A humidifying pan is placed in one side chamber to receive water for humidifying the air passing through the chamber.

U.S. Pat. No. 4,010,729 issued to Egli on Mar. 8, 1977, discloses a fireplace grate in which the grate comprises tubular conduits and an inlet communicating with an electrically operated fan and an extendable outlet. Air passes through the tubular conduits and is heated by the hot ashes falling onto the grate.

The above described fireplace heaters use chambers of conduits wherein the heat from the fire heats the pipe or walls of the heater and the heat is directly transferred to the circulating air. The moistening devices are placed within the flues or within the chambers at the outlet such that preheated air picks up moisture from the water pan container or other similar device. The water is not used to heat the air passing thereover.

SUMMARY OF THE INVENTION

According to the invention, a fireplace heater has a conduit made from a heat conducting material. The conduit has an inlet opening, outlet opening, a water containing bottom portion along the length of the conduit, and an upper portion.

A fan means is mounted adjacent one of the openings for circulating air through the inlet, upper portion and the outlet opening.

Desirably, the conduit is shaped with a rear and side sections that substantially circumscribe the rear and sides of a central open area. Preferably, the central open area has a grate fixedly connected to the conduit. The conduit has an adjacent wall and far wall with respect to the central open area. The adjacent wall is made from a heat conducting material such as steel. The inlet opening and outlet opening are positioned in an upper portion of the conduit.

Preferably, an extendible tube is slidably mounted in the outlet opening for directing discharged air away from a fire and preventing the discharged air from blowing any smoke from a fire in the central open area.

Further, the inlet opening is at a front end of a second side portion such that the fan circulates air in order, through the inlet, the second side portion, the rear portion and one side portion and then out through the outlet.

In one embodiment, the grate is fixed to the bottom of the conduit such that the water containing bottom portion is above the grate. The water within the bottom portion is in direct contact with the adjacent wall in heat exchange relationship therewith. The bottom portion is preferably a continuous uninterrupted channel at the bottom of the rear and side sections of the conduit.

The fan is preferably mounted to the exterior of the inlet and surrounded by heat protective casing. The heat protective casing has a passageway therethrough for passing ambient air into the inlet.

Preferably, the conduit is U-shaped with two side leg sections and a rear leg section in fluid communication with the two side leg sections. The fireplace grate is fixed to the conduit between the two side leg sections in front of the rear leg section.

DETAILED DESCRIPTION OF THE PREFERRED EMBODIMENT

Figure 1:
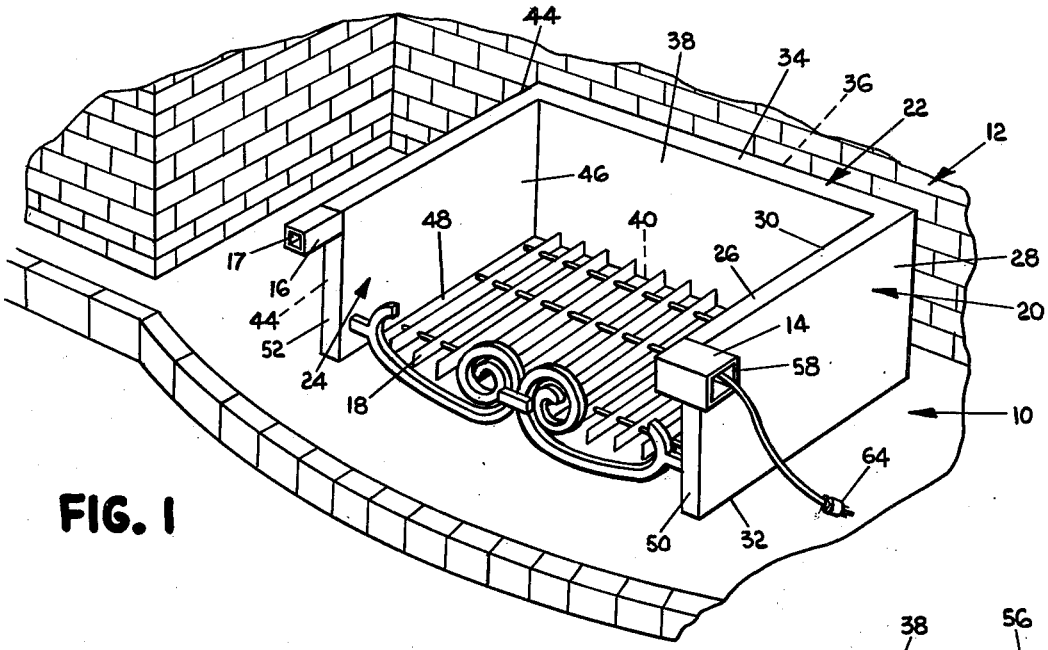
FIG. 1 is a perspective view of an embodiment of the invention shown in a fireplace.
Figure 2:
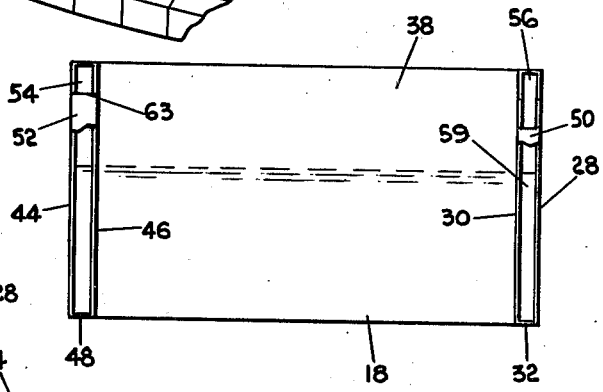
FIG. 2 is a fragmentary front elevation and partially broken view of the invention shown in FIG. 1.

Referring to the drawings, particularly to FIG. 1, a fireplace heater 10 is placed within a fireplace 11. Fireplace heater has a container 12 attached to a grate 18. The container 12 is U-shaped with two side sections 20 and 24 and a rear section 22. The side sections 20 and 24 and rear sections 22 are in fluid communication with each other such that the container 12 functions as a conduit. The side 20 has a top cover 26, a front end wall 50, outer wall 28, an inside wall 30 and a bottom floor 32 (FIG. 2). The rear section has a top cover 34, an outer wall 36, an inner wall 38 and a bottom floor 40. The side section 24 has a top cover 42, an outer wall 44, innner wall 46, a bottom floor 48 and a front end wall 52.

Referring to FIG. 2, an upper portion of the end wall 52 has an outlet opening 54. An upper portion of the front end wall 50 has an inlet opening 56.

Figure 3:
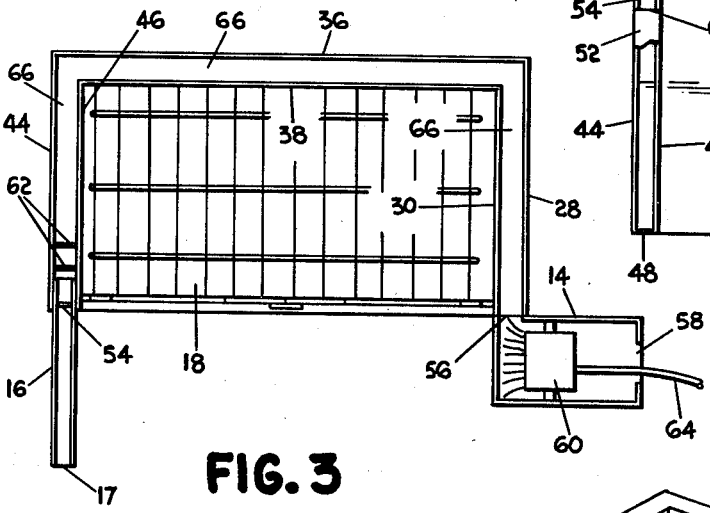
FIG. 3 is a partially broken plan view of the fireplace heater as shown in FIG. 1.

As more clearly shown in FIG. 3, a hollow interior 66 is formed between the walls, covers, and floors of the container. The inlet and outlet are in communication with the hollow interior 66. The hollow interior is in heat exchange relationship with the inner walls 30, 38 and 40.

As clearly shown in FIG. 2, the bottom portion of the container 12 is capable of holding water 59 up to the bottom edges 61 and 63 of the inlet 56 and outlet 54, respectively.

Referring back to FIGS. 1 and 3, a fan box 14 is mounted over the inlet 56. Within the fan box is a fan 60 operably connected to a power cord 64. The fan box 14 has an opening 58 so that the fan can draw in ambient air through opening 58 and to exhaust the air through inlet 56.

As shown in FIG. 3, support 62 extends from inner wall 46 to outer wall 44 and aligned with the bottom edge 63 of outlet 54. A tube 16 fits within outlet 54 and is slidable through the outlet 54 and supported from beneath by the support 62. The tube snugly fits within outlet 54 so that substantially all circulating air passing through outlet 54 also passes through the tube 16. The tube 16 is slidable so that its front end 17 can be positioned in a desired forward position.

Figure 4:
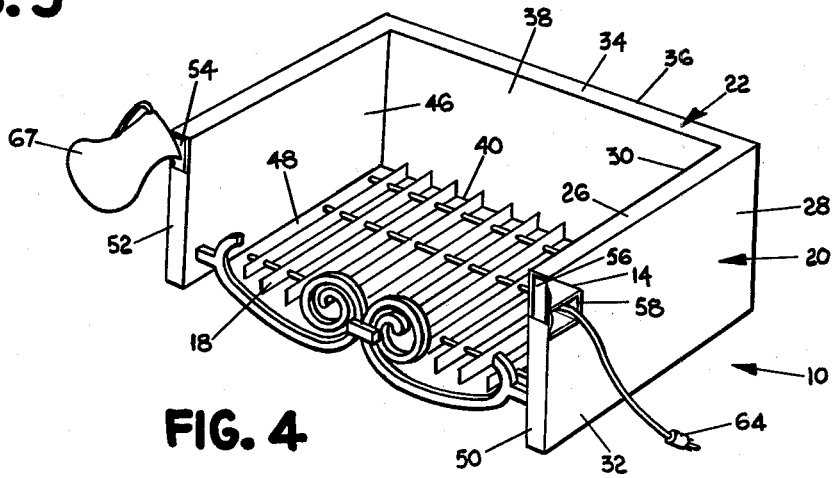
FIG. 4 is a perspective partially broken view of a fireplace heater as shown in FIG. 1 with the conduit extension removed for water refilling.

As shown in FIG. 4, the tube 16 may be removed from outlet 54 so that a bottom portion 57 can be easily refilled by a pitcher 67 or a hose (not shown), or other water carrying device.

In operation, water is poured through the outlet 54 to the bottom portion 57 of the container. Wood or other suitable solid fuel is placed on the grate 18 and a fire is started over the grate. Power cord 64 is plugged into a power source to operate the fan 14. The fan circulates air through the opening 58 and through inlet 56. Air circulates through the upper portion 55 of the hollow interior 66 through the side section 20, rear section 22, side section 24 and is discharged through outlet 56, and through tube 16, passing through the open front end 17 of the tube 16.

As the fire burns, the inner walls 30, 38 and 40 are heated. Water within the bottom portion 57 of the container is in heat exchange relationship with the inner wall 30, 38 and 40 is also warmed and vaporizes. The warmed water evaporates into the air circulating in the upper portion of the container. The circulating air is thus substantially warmed and humidified by the evaporating water before it exits through the outlet 64. The circulating air is also in heat exchange relationship with the inner walls 30, 38 and 40. Both the heated water and inner walls 30, 38 and 40 warm the air before it exits the outlet 54.

The air is circulated through the hollow interior 66 at such a rate that the air continuously draws off the water vapor so that the water does not boil. Therefore, the air is moist but not saturated with water, and the air is not at a temperature where it would be dangerous.

The front end 17 of tube 16 is adjustable so that it can direct the circulating air to a point in front of the fire above grate 18 and away from the gasses of combustion emanating from the fire. The front end 17 also directs the heated, humidified air out into a room away from the flue so no heated air is drawn out up through the flue and wasted.

In this fashion, a fireplace heater efficiently transfers heat between the fire and circulating air. In particular, the body of water at the bottom portion of the fireplace heater container maximized heat transfer between the fire and the air. Since heat exchanges occur more quickly between a solid and a liquid than between a solid and air, heat is rapidly transferred into the water from the hot walls 30, 38 and 40 and the heated water is entrained in the air. Thus, the water functions as an effective heat transfer mechanism, i.e., from hot walls to air, and also humidifies the circulating air to put moisture into a room that is heated by the fireplace heater.

Reasonable variation and modification are possible within the scope of the foregoing disclosure and drawings without departing from the spirit of the invention which is defined by the appended claims.

The embodiments of the invention in which an exclusive property or privilege is claimed are defined as follows:

1. A fireplace heater for placement in a solid fuel burning fireplace, the fireplace heater comprising:

a conduit comprising a heat conducting material forming a container shaped with rear and first and second side sections to substantially define a central area for placement of a fire;, a bottom portion extending along the rear and side sections of the container and containing a substantial depth of water along the substantially entire length of the conduit, and an upper portion above the bottom portion, an inlet opening extending through the upper portion of the conduit for receiving ambient air and located at a front end of said first side section, and an outlet opening extending through the upper portion of the conduit for discharging air therefrom and located at a front end of said second side section;

at least one wall of the bottom portion of the conduit having a heat exchange wall for transferring heat from the fire directly to water in said bottom portion; and means for circulating air through the inlet, upper portion, and outlet; the circulating air passing over the water in the bottom portion to pick up heated water vapor as the air passes through the upper portion, whereby heated moist air is passed into a room adjacent the fire-place.

2. A fireplace heater as defined in claim 1 and further comprising;

a central fireplace grate placed in the central area and connected to the container at the outer periphery of the grate.

3. A fireplace heater as defined in claim 2 wherein the grate is fixed to the bottom of the container such that the bottom portion extends above the grate.

4. A fireplace heater as defined in claim 3 wherein the bottom portion comprises a continuous channel through the rear and side sections.

5. A fireplace heater as defined in claim 1 and further comprising:

an extendible conduit means slidably mounted in the outlet opening for adjusting the point at which the heated and humidified circulating air passes from the conduit, and to prevent the circulating air from blowing any smoke emanating from a fire in the central area.

* * * * *